United States Patent [19]

Siddiqi

[11] Patent Number: 4,482,583

[45] Date of Patent: Nov. 13, 1984

[54] PROCESS FOR SEALING REAGENT RIBBONS

[75] Inventor: M. Sultan Siddiqi, Elkhart, Ind.

[73] Assignee: Miles Laboratories, Inc., Elkhart, Ind.

[21] Appl. No.: 496,453

[22] Filed: May 20, 1983

[51] Int. Cl.[3] ..... B05D 5/00

[52] U.S. Cl. ..... 427/284; 427/285

[58] Field of Search ..... 427/284, 285; 118/DIG. 15, DIG. 20, 221, 225, 227, 234

[56] References Cited

U.S. PATENT DOCUMENTS 2,269,150 1/1942 Flynn ..... 118/234 X

*Primary Examiner*—Evan K. Lawrence

*Attorney, Agent, or Firm*—Roger N. Coe

[57] ABSTRACT

A process for sealing the edges of reagent ribbon using a grooved applicator roll such that the edges of the reagent ribbon become effectively sealed and liquid present in the reagent matrix material is retained therein and prevented from running over into another reagent matrix area present on the same reagent test device.

4 Claims, 2 Drawing Figures

PROCESS FOR SEALING REAGENT RIBBONS

BACKGROUND OF THE INVENTION

1. Field of the Invention

The present invention relates to a process for continuously sealing reagent ribbons and, more particularly, to a process and apparatus for applying a sealing composition to the edges of reagent ribbons.

The art of analytical chemistry has been greatly advanced since biochemistry began emerging as a primary scientific frontier, requiring increasingly sophisticated analytical methods and tools to solve problems. Likewise the medical profession has lent impetus to the growth of analytical chemistry, with its desiderata of both high precision and speed in obtaining results.

To satisfy the needs of the medical profession as well as other expanding technologies, such as the brewing industry, chemical manufacturing, etc., a myriad of analytical procedures, compositions and apparatus have evolved, including the so-called "dip-and-read" type reagent test device. Reagent test devices enjoy wide use in may analytical applications, especially in the chemical analysis of biological fluids, because of their relatively low cost, ease of usability, and speed in obtaining results. In medicine, for example, numerous physiological functions can be monitored merely by dipping a reagent test device into a sample of body fluid, such as urine or blood, and observing a detectable response, such as a change in color or a change in the amount of light reflected from or absorbed by the test device.

Many of the "dip-and-read" test devices for detecting body fluid components are capable of making quantitative or at least semiquantitative measurements. Thus, by measuring the response after a predetermined time, an analyst can obtain not only a positive indication of the presence of a particular constituent in a test sample, but also an estimate of how much of the constituent is present. Such test devices provide the physician with a facile diagnostic tool as well as the ability to gage the extent of disease or of bodily malfunction.

Illustrative of such test devices currently in use are products available from the Ames Division of Miles Laboratories, Inc. under the trademarks CLINISTIX, MULTISTIX, KETOSTIX, N-MULTISTIX, DIASTIX, DEXTROSTIX, and others. Test devices such as these usually comprise one or more carrier matrices, such as absorbent paper, having incorporated therein a particular reagent or reactant system which manifests a detectable response, e.g., a color change, in the presence of a specific test sample component or constituent. Depending on the reactant system incorporated with a particular matrix, these test devices can detect the presence of glucose, ketone bodies, bilirubin, urobilinogen, occult blood, nitrite, and other substances. A specific change in the intensity of color observed within a specific time range after contacting the test device with a sample is indicative of the presence of a particular constituent and/or its concentration in the sample. Some of these test devices and their reagent systems are set forth in U.S. Pat. Nos. 3,123,443; 3,212,855; 3,814,668; etc.

Thus, it is customary for reagent test devices to contain more than one reagent bearing carrier matrix, in which each reagent bearing carrier matrix is capable of detecting a particular constituent in a liquid sample. For example, a reagent test device could contain a reagent bearing carrier matrix responsive to glucose in urine and another matrix responsive to ketones, such as acetoacetate, which is spaced from, but adjacent to, the glucose responsive matrix. Such a product is marketed by the Ames Division of Miles Laboratories, Inc. under the trademark KETO-DIASTIX. Another reagent test device marketed by the Ames Division of Miles Laboratories, Inc., N-MULTISTIX, contains eight adjacent reagent incorporated matrices providing analytical measurement of pH, protein, glucose, ketones, bilirubin, occult blood, nitrite, and urobilinogen.

Despite the obvious, time-proven advantages of such multiple reagent test devices as these, misuse can result in misinformation. These multiple analysis tools comprise complex chemical and catalytic systems, each reagent matrix containing a unique reactive system, responsive to its particular analyte. Thus, it is possible, if the reagent test device is misused, for chemicals to be transported by the liquid sample being analyzed from one carrier matrix on the reagent test device to another. Should this happen it is possible for reagents from one carrier matrix to interfer with those of the other so contacted causing unreliable results. Although it is common in the reagent test device industry to provide detailed instructions of how this problem is avoided, i.e., directions for properly manipulating the reagent test devices by blotting excess fluid, etc., nevertheless ignorance or disregard of these instructions could permit reagents from one matrix to run over onto an adjacent one. It is the prevention of this "runover" problem that the present invention is primarily directed.

The elimination of runover has been long sought after and the present discovery, which is the cumulation of an extensive research effort, provides a very effective solution to this problem.

2. Discussion of the Prior Art

The patent literature is replete with accounts of myriad attempts at curtailing runover, the great bulk of the emphasis being directed to two basic concepts: the adsorbance of runover liquid by bibulous layers placed beneath the reagent-bearing layers of reagent test devices; and the use of hydrophobic barriers between the spaced matrices. The former has met with moderate success, whereas the latter approach has not.

Of the multilayer type reagent test devices, U.S. Pat. No. 4,160,008 describes a test device in which the carrier matrices containing reagent formulations are provided with adsorbent underlayers which are separated therefrom by sample impervious barrier layers. Each matrix thus forms the upper layer of a laminate composite in which the barrier layer is disposed between the matrix and the adsorbent base layer, the composite being fixed to a suitable support such as a plastic substrate. When the test device is dipped into the liquid sample the portion of sample which would otherwise runover from one matrix to another is largely adsorbed into the underlayer of the latter through the exposed sides, the barrier layer of the composite segregating the adsorbed runover from the upper reagent layer.

U S. Pat. No. 4,301,115 discloses and claims a test device comprising a base support member coated with a hydrophobic barrier layer to which a plurality of spaced apart reagent matrices are affixed. This approach virtually eliminates cross-contamination between adjacent reagent areas of multiple reagent test devices, but requires an extra step of applying hydrophobic material to the base support member of the reagent test device.

With respect to the development and use of barriers and/or barrier materials between reagent matrices, the patent art is replete with teachings, which in theory, at least, would seem to overcome the runover problem.

U.S. Pat. No. 3,418,083 discloses an indicator-impregnated adsorbent carrier matrix treated with wax, oil or similar "hydrophobic" agents. It is stated that when a sample of blood is placed on the resulting reagent test device, only colorless liquid components permeate it, the proteinaceous, colored blood components remain on the surface where they can be removed. Thus, it is taught that the liquid portion bearing the analysate permeates the reagent matrix pad and color interference is precluded.

Still another prior art patent, U.S. Pat. No. 3,001,915, describes an adsorbent paper reagent test device having spaced reagent-impregnated test areas for more than one sample component, each such area being separated from the other reagent-impregnated test area by a nonadsorbent barrier portion. The barrier is provided by impregnation of the paper strip with materials such as polystyrene, rosin, paraffin and various cellulose esters. The reagent strip is prepared, according to the reference, by impregnating a portion of the paper strip with a glucose sensitive reagent system. When dry, a solution of one or more of the barrier materials is applied to the paper adjacent a glucose sensitive portion. After further drying a protein sensitive reagent system is applied and the process is repeated with alternate applications of reagent and barrier solutions with drying steps inbetween.

Yet an earlier patent, U.S. Pat. No. 2,129,754, describes the impregnation of filter paper with paraffin wax whereby specific areas are left unimpregnated and these areas are treated with indicator systems for a particular analyte.

In U.S. Pat. No. 3,006,735, the concept of barrier material impregnated between reagent areas of a reagent test device is carried one step further by providing successive reagent areas responsive to different degrees of water hardness. Water repellent material, such as oils, waxes, silicones, and printer's varnish, is impregnated betweeen these reagent test areas. Like the proceeding two patents, this citation is restricted to paper or like bibulous material wherein reagent and barrier material alike are impregnated sequentially along its length.

Similarly U.S. Pat. Nos. 3,011,874 and 3,127,281 teach the use of hydrophobic barrier materials impregnated in part of a reagent test device in order to separate one reagent area from another and thereby avoid contamination.

Yet another patent which mentions the separation of indicator reagent sites by the use of nonadsorbent or hydrophobic materials in U.S. Pat. No. 3,964,871.

Whereas the foregoing patents represent what is believed to be the most pertinent prior art to the present invention, it should be noted that currently marketed reagent test device products for the most part contain reagent impregnated matrices affixed to hydrophobic organoplastic material. Thus, the multiple reagent test device known as N-MULTISTIX contains eight different reagent impregnated matrices mounted on a polystyrene film. Since polystyrene is hydrophobic, the reagent strip can be said to have hydrophobic interstices between adjacent matrices.

Despite lip service given by prior art accounts of eliminating runover, the fact remains that the problem continues to exist. The approaches disclosed in U.S. Pat. Nos. 4,160,008 and 4,301,115 have come the closest to eliminating this runover problem.

Prior art attempts using wax, oils, silicones, etc., have not curtailed runover to a clinically significant extent; and what modest advances have been made are more than offset by serious drawbacks inherent to such attempts. For example, applying hydrophobic material only at reagent area interstices embodies enormous technical problems, especially when compared with the current techniques for manufacturing dip-and-read reagent test devices. Besides the obvious extra steps required by interstitial application, there is the danger of some of the hydrophobic material overlapping the reagent area thereby interfering with the paramount purpose of the reagent test device. Moreover, none of the prior art substances provides a suitable surface for adhesion.

Even if the above shortcomings were not prohibitive enough, the prior art hydrophobic substances lack a degree of hydrophobicity required to prevent runover. They do not provide a sufficient contact angle to achieve the required hydrophobicity, nor do they provide a suitable surface for binding either the adsorbent matrices or the reagent themselves, where they are coated directly on the substrate surface.

The present invention virtually eliminates cross-contamination between adjacent reagent areas of multiple reagent test device matrices. The results are truly incontrovertible and the success achieved in solving this problem compares favorably with the use of a hydrophobic barrier layer, as described in U.S. Pat. No. 4,301,115. Moreover, the present invention does not require the presence of an additional layer applied to the substrate of reagent test devices. The present invention, involving the sealing of two of the edges of a reagent matrix area, can be accomplished quickly and inexpensively during conventional procedures used for forming reagent test devices.

SUMMARY OF THE INVENTION

An object of the present invention is to provide a process for continuously sealing edges of reagent ribbons and hence carrier matrices in a way which prevents or substantially eliminates runover problems on reagent test devices containing multiple carrier matrices.

Another object of the present invention is to provide a method for substantially eliminating runover problem by sealing the edges of reagent ribbons during the production of the reagent test devices in a manner which does not interfer with the impregnated reagents in the carrier matrix.

Still another object of the present invention is to provide an inexpensive and effective method of eliminating or materially reducing runover.

In accordance with the present invention, a process for continuously sealing two opposite sides of a reagent ribbon prior to the application of the reagent ribbon to a substrate material by means of double backed adhesive material and slitting the resulting reagent cards to provide individual reagent test devices is disclosed. The sealing process is accomplished employing a v-groove applicator roll which picks up sealing material, such as paraffin, from a heated container and applies it to the edges of reagent ribbon such that only the edges of the reagent ribbon are sealed and the sealing material never contacts the reagent matrix ribbon except at its peripheral edges. A wide variety of sealing materials can be used, including materials which have been recognized in the past as effective water repellent materials. The apparatus provides accurate and effective application of sealing material to the edges of the reagent ribbon at speeds as high as 20 revolutions per minutes (rpm) or higher.

BRIEF DESCRIPTION OF THE DRAWINGS

Other and further objects, advantages and features of the invention will be apparent to those skilled in the art from the following detailed description thereof, taken in conjunction with the accompanying drawings, in which.

DESCRIPTION OF THE PREFERRED EMBODIMENTS

Figure 1:
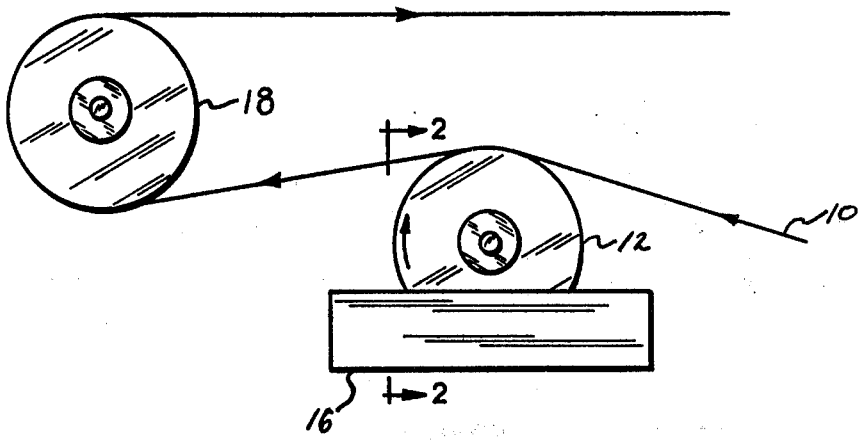
FIG. 1 is a schematic side view, partially in cross-section, of a reagent ribbon passing over a v-groove applicator roll which applies sealing material to the edges of the reagent ribbon in accordance with the present invention.
Figure 2:
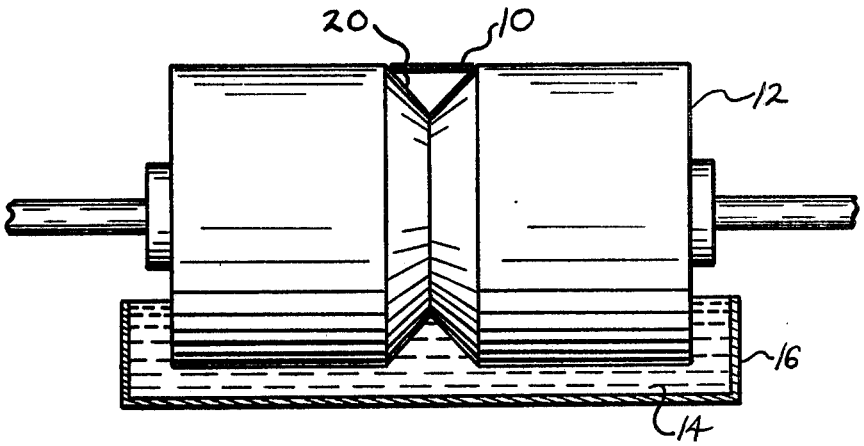
FIG. 2 is an enlarged schematic end view, partially in cross-section, taken along lines 2—2 of FIG. 1, illustrating the v-groove applicator roll applying sealing material to the edges of reagent ribbon.

The process forming the subject matter of the present invention can be described best by reference to the accompanying drawings. As illustrated in FIGS. 1 and 2, reagent ribbon 10 passes over a v-groove applicator roll 12 which is motor driven (not shown) to pick up sealing material 14, such as liquid paraffin, from a heated open too container 16 and cause the sealing material to be applied to the edges of reagent ribbon 10.

There is best seen in FIG. 2 of the drawings which illustrates the v-groove applicator roll 12 rotating in heated container 16. As v-groove applicator roll 12 rotates, sealing liquid 14 is picked up by the applicator roll and applied to the edges of reagent ribbon 10 which rest on opposite sides of v-groove 20.

After the sealing material seals the edges of the reagent ribbon the ribbon is wound on a spool or transported by suitable means, such as tension roll 18, to another stage of the operation. Once the edge sealed reagent ribbon has been sealed on its edges, the reagent ribbon can be applied to a plastic substrate or card using double backed adhesive in the conventional manner and reagent test devices made by slitting the cards thus formed.

Thus, the apparatus depicted in FIGS. 1 and 2 applies the sealing liquid material only to the edges of the reagent ribbon and does not otherwise affect the reagent impregnated ribbon. Accordingly, upon drying, the sealing liquid effectively seals the ends of the reagent matrix material and does not interfer with the reaction which takes place when the reagent test device is dipped into a liquid, such as a body fluid or industrial liquid, to be tested.

The sealing material utilized to seal the edges of the reagent ribbon 10 can be any material which can be effectively applied to impregnate the edges of the reagent ribbon and provide water-repellency. Thus, materials such as oils, waxes, paraffin, silicones, and printer's varnish can be utilized as well as polymeric materials. In addition to water-repellency, the sealing material should have the characteristic of reasonable viscosity at elevated temperatures such that it can be easily applied via the v-groove applicator roll 12 to the edges of the reagent ribbon and then dry quickly at room temperature or a slightly elevated temperature and remain solid over the normal temperature range for reagent test devices. Clearly, there should be no interaction between the sealing material and the reagent(s) present in the reagent ribbon. Waxes are especially useful for this purpose since they are thermoplastic, water repellent, have a smooth texture, are nontoxic, and have freedom from any objectionable odor or color. Major types of waxes which can be employed include natural waxes, such as animal wax, beeswax, spermaceti, lanolin, shellac wax; vegetable waxes, such as carnauba, candelilla, bayberry, sugar cane; mineral waxes, such as fossil or earth waxes, including ozocerite, ceresin, montan; and petroleum waxes, such as paraffin, microcrystalline, petrolatum; as well as synthetic waxes such as ethylenic polymers and polyolether-esters including Carbowax, sorbitol and cholorinated napthalenes such as Halowax and other hydrocarbon waxes.

The reagent ribbon can be formed with any suitable material. U.S. Pat. No. 3,846,247 teaches the use of felt, porous ceramic material and woven or matted glass fibers. Additionally, U.S. Pat. No. 3,552,928 teaches the use of wood material, cloth, sponge material and argillaceous substances. The use of synthetic resin fleeces and glass fiber felts as carrier matrix is suggested in British Patent No. 1,369,139. Another British Patent, No. 1,349,623, proposes the use of light permeable meshwork of thin filaments as a cover for an underlying paper matrix. Polyimide fibers are taught in French Patent No. 2,170,397. Notwithstanding these suggestions, however, the material predominantly used in the art as a carrier matrix and that which is especially useful in the present invention is bibulous paper such as filter paper.

As indicated above, the reagent ribbon is normally impregnated and contains reagent material prior to the sealing of the edges of the reagent ribbon in accordance with the present invention. Following application of the sealing material to the edges of the reagent ribbon, and after any drying which may be required at room or elevated temperatures, the reagent ribbon can be fastened to a card of suitable substrate material such as Trycite (polystyrene) using double faced adhesive tape such as Doublestick available from the 3M Company. Following conventional techniques, the card containing reagent ribbons adhesively bound thereto is then cut widthwise to form reagent test devices. These reagent test devices can measure, for example, $8\times0.5$ centimeters having 0.5 centimeter squares of reagent laden carrier matrices at one end thereof, the other end serving as a handle for the reagent test device. Since the edges of the reagent matrix material which face each other on the resulting reagent test device are sealed by the sealing material in accordance with the present invention, liquid runover problem and the problems created by runover are effectively eliminated or substantially reduced.

The heated tray can be heated by any suitable means (not shown) to a temperature sufficient to maintain the sealing material in liquid form until it is applied to the edges of the reagent ribbon.

V-groove applicator roll 12 can be made of any suitable material, such as metal or plastic. In FIG. 2, v-shaped groove 20 is shown as a 90° angle. This angle can be varied significantly without affecting the overall application provided sufficent distance is retained between the bottom of the groove 20 and the under surface of reagent ribbon 10 such that sealing liquid 14 is applied only to the edges of the reagent ribbon and not to any other portion of the ribbon. A u-shaped groove can also be used, but a v-groove is preferred. If desired, multiple grooves can be present in the same applicator roll thereby permitting multiple reagent ribbons to be sealed simultaneously. The speed of the applicator roll can be varied using suitable means (not shown), but normally the speed would be in the range of 5 to 20 rpm. While it is preferred to have v-groove applicator roll 12 rotate in a clockwise direction, counter to the movement of the reagent ribbon, the direction of the applicator roll could be reversed.

Take-up roll 18 does not form part of the invention, but merely indicates a convenient way of maintaining appropriate tension on the reagent ribbon such that there is more than momentary contact between the reagent ribbon and the sealing liquid which is entrained by the v-groove. This takeup roll, or other suitable means, can be raised or lowered, as required, to effectively control the amount of sealing liquid applied to the edges of the reagent ribbon.

From the foregoing, it will be seen that this invention is well adapted to attain all of the ends and objects hereinabove set forth, together with other advantages which are obvious and which are inherent to the system. The process of the present invention and apparatus used have the advantages of convenience, simplicity, relatively inexpensiveness, positiveness, effectiveness, durability, accuracy and directness of action. The invention substantially overcomes problems associated with runover which have been a continuing and long felt problem with multiple reagent test devices. The invention provides a very effective, simple and inexpensive way of eliminating or materially reducing the runover problem. In addition, the process of the present invention can effectively be utilized in conjunction with conventional techniques or methods for forming reagent test devices. There is no extra layer which must he applied to reagent test devices in order to control the runover problem. Nevertheless, the present invention could be used in conjunction with other techniques found useful to control the runover problem if one so desired. Thus, the present invention could be utilized in conjunction with techniques in the prior art which rely on the use of hydrophobic barrier layers affixed to reagent test devices.

Obviously, many other modifications and variations of the invention as hereinbefore set forth can be made without departing from the spirit and scope and thereof.

What is claimed is:

1. The process of sealing two opposite edges of substantially flat reagent ribbon without otherwise affecting impregnated reagent in said reagent ribbon, which process comprises, passing the impregnated reagent ribbon over a circumferentially grooved applicator roll which applicator roll is partially submerged in a heated container having sealing liquid which is entrained by the grooved roll as the applicator roll rotates such that sealing liquid from the heated sealing liquid container is transported to and contacts only the edges of the reagent ribbon as the reagent ribbon is suspended in the groove of the applicator roll by its edges and maintaining the reagent ribbon in contact with the grooved applicator roll for sufficient period of time to cause the liquid sealing material to contact and seal the edges of the reagent ribbon.

2. The process of claim 1 in which the sealing liquid is paraffin.

3. The process of claim 1 in which the sealing liquid is an oil.

4. The process of claim 1 in which the sealing liquid is silicone.

* * * * *